US006483230B1

(12) United States Patent
Oda et al.

(10) Patent No.: US 6,483,230 B1
(45) Date of Patent: Nov. 19, 2002

(54) HIGH PRESSURE METALLIC VAPOR DISCHARGE LAMP

(75) Inventors: Shigefumi Oda, Osaka (JP); Hiroshi Nohara, Hyogo (JP); Yoshiharu Nishiura, Shiga (JP); Shiki Nakayama, Osaka (JP); Takashi Yamamoto, Osaka (JP); Masanori Higashi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/743,626

(22) PCT Filed: May 25, 2000

(86) PCT No.: PCT/JP00/03382

§ 371 (c)(1),
(2), (4) Date: Jan. 12, 2001

(87) PCT Pub. No.: WO00/74106

PCT Pub. Date: Jul. 12, 2000

(30) Foreign Application Priority Data

May 28, 1999 (JP) ..... 11-149717

(51) Int. Cl.[7] ..... H01J 1/02
(52) U.S. Cl. ..... 313/25; 313/623
(58) Field of Search ..... 313/25, 567, 571, 313/576, 623, 624, 625

(56) References Cited

U.S. PATENT DOCUMENTS 5,015,916 A 5/1991 Mazza et al. ..... 315/47
5,424,609 A * 6/1995 Geven et al. ..... 313/331
5,557,169 A * 9/1996 Van Lierop et al. ..... 313/623
5,742,124 A * 4/1998 Kees et al. ..... 313/624
5,994,839 A 11/1999 Yamamoto et al. ..... 313/570

FOREIGN PATENT DOCUMENTS

| | | |
|---|---|---|
| JP | 60-59459 | 4/1985 |
| JP | 62-150646 | 7/1987 |
| JP | 62-283545 | 12/1987 |
| JP | 3-194849 | 8/1991 |
| JP | 8-287874 | 11/1996 |
| JP | 10-106491 | 4/1998 |
| JP | 10-172513 | 6/1998 |

OTHER PUBLICATIONS

Verification Translation

* cited by examiner

*Primary Examiner*—Don Wong
*Assistant Examiner*—Thuy Vinh Tran
(74) *Attorney, Agent, or Firm*—Merchant & Gould P.C.

(57) ABSTRACT

A discharge tube (1) made of transparent ceramics includes a main tube (17) and slender tubes provided on both sides thereof. In one of the slender tubes, a main electrode lead-in member that is connected to a main electrode (6*b*) is inserted and sealed. In the other two-hole slender tube, a main electrode lead-in member that is connected to a main electrode (6*a*) and an auxiliary electrode lead-in member that is connected to an auxiliary electrode (9) are inserted and sealed so as to be isolated electrically from each other. With such a structure, it is possible to achieve highly efficient and stable lifetime characteristics and suppress changes in characteristics during lifetime caused by leaks during an operation and reaction between a sealing material and an enclosed material inside the discharge tube. In addition, it is possible to obtain a high-pressure metal vapor discharge lamp that has stable lamp starting characteristics and allows a free design of the discharge tube.

11 Claims, 11 Drawing Sheets

HIGH PRESSURE METALLIC VAPOR DISCHARGE LAMP

TECHNICAL FIELD

The present invention relates to a high-pressure metal vapor discharge lamp having a discharge tube made of transparent ceramics.

BACKGROUND ART

Conventionally, high-pressure metal vapor discharge lamps of this type often are known to have a quartz discharge tube as shown in FIG. 9. In other words, a quartz discharge tube 34 having a pair of main electrodes 31 and 32 and an auxiliary electrode 33 therein is provided, and the auxiliary electrode 33 is disposed next to the main electrode 32. The discharge tube 34 also has a discharge portion 35 as a discharge space and sealing portions 36 and 37 that are provided at both ends of the discharge portion 35. In the sealing portions 36 and 37, electrode rods 38 and 39 supporting the main electrodes 31 and 32 at their tips, metal foils 40 and 41 that are made of molybdenum and whose one end is connected to the rear end of the electrode rods 38 and 39 and external lead wires 42 and 43 whose one end is connected to the other end of the metal foils 40 and 41 are integrated to be current supply conductors for the main electrode, and an auxiliary electrode rod 44 supporting the auxiliary electrode 33 at the tip, a metal foil 45 that is made of molybdenum and whose one end is connected to the rear end of the auxiliary electrode rod 44 and an external lead wire 46 whose one end is connected to the other end of the metal foil 45 are integrated to be a current supply conductor for the auxiliary electrode. The current supply conductors for the main electrode and the current supply conductor for the auxiliary electrode are sealed by crushing so that the main electrodes 31 and 32 and the auxiliary electrode 33 at their tips are located in the discharge portion 35. Also, a Ne—$N_2$ mixed gas is sealed in an outer tube 2.

When starting the operation of such a high-pressure metal vapor discharge lamp, an auxiliary discharge first is generated between the main electrode 32 and the auxiliary electrode 33 provided next to this main electrode 32, followed by a transition to a main discharge between the main electrodes 31 and 32.

In particular, metal halide lamps, which are one type of the high-pressure metal vapor discharge lamps having the above-described structure, are used widely as ones to which inexpensive ballast for mercury lamps are applicable.

JP 62(1987)-150646 A, directed to a ceramic discharge lamp, discloses a ceramic discharge tube with the following structure. That is, as shown in FIG. 10, electrically conductive cermet disks 53*a* and 53*b* supporting main electrode rods 52*a* and 52*b* are sealed air-tight at the ends of a discharge tube 51. The disk 53*a* supports an auxiliary electrode 54 so that the auxiliary electrode 54 is insulated from the main electrode rod 52*a* via an insulating layer 55.

Also, JP 10(1998)-106491 A, directed to a high-pressure metal vapor discharge lamp, discloses the following structure. That is, a discharge tube 61 is disclosed to have a structure in which, as shown in FIG. 11, transparent ceramic disks 64*a* and 64*b* provided with slender ceramic tubes 63*a* and 63*b* in which electrode lead-in wires 62*a* and 62*b* as electrode lead-in members are sealed are provided at both ends of a main tube 68 made of transparent ceramics, and that the disk 64*a* further is provided with a slender ceramic tube 63*c* for the auxiliary electrode.

However, those types of discharge lamps have had following problems.

In the high-pressure metal vapor discharge lamp including the conventional quartz discharge tube as shown in FIG. 9, the sealing portions of the discharge tube are sealed by crushing during its manufacture, resulting in varying shapes. This shape variation has caused variation in lamp characteristics.

When the sealing portions are large, thermal loss from a discharge space of the discharge tube increases, making it difficult to obtain a sufficient efficiency and a high color rendition. Thus, it is necessary to reduce the size of the sealing portions as much as possible. However, in the quartz discharge tube, since it is necessary to seal the metal foil 41 on the main electrode side and the metal foil 45 on the auxiliary electrode side so as to space them away at a certain distance and prevent their contact, the size reduction of the sealing portion 37 has been difficult.

Also, in this type of high-pressure metal vapor discharge lamp, a Ne—Ar mixed gas is used as a starting gas for the purpose of lowering a starting voltage at discharge start-up. However, since Ne permeates the quartz as a discharge tube material, a mixed gas containing Ne needs to be sealed in the outer tube 2 so as to prevent this permeation. On the other hand, when the gas is sealed in the outer tube 2, the thermal loss from the discharge tube 34 increases. Accordingly, in order to obtain sufficient characteristics, it is necessary to tolerate a deterioration of lifetime characteristics to a certain degree and increase a tube-wall load of the lamp. Such deterioration of lifetime characteristics is caused by a reaction between quartz in a wall portion of the discharge tube and a metal halide that has been sealed. Thus, it has been desired that such reaction between the quartz as the discharge tube material and the sealed metal halide is suppressed.

On the other hand, in the lamp disclosed in JP 62-150646 A using ceramics for the discharge tube, variation in the shape of the discharge tube can be suppressed, thus making it possible to improve quality regardless of the presence or absence of the gas in the outer tube. However, since an electrically conductive cermet 56 having the auxiliary electrode 54 is sealed air-tight with a sealing material 57 in a portion reaching a relatively high temperature during the lamp operation, leaks in the discharge tube during the operation or the reaction between the sealing material and enclosed metals are inevitable. Especially, in metal halide lamps using metal halide as a discharge metal, a violent reaction occurs.

In the lamp disclosed in JP 10-106491 A in which the electrode lead-in members are sealed in the slender ceramic tubes, the reaction between the sealing material and the enclosed metals can be avoided. However, when attempting to obtain a reliable mechanical strength of the disk 64*a,* it is difficult to reduce the distance between a main electrode 65*a* and an auxiliary electrode 66 and the shape of end portions of the discharge tube becomes limited. Consequently, it is difficult to design the discharge tube for the purpose of obtaining desired lamp characteristics.

DISCLOSURE OF INVENTION

The present invention was made in order to solve the problems described above, and it is an object of the present invention to provide a high-pressure metal vapor discharge lamp that prevents the occurrence of variations in characteristics caused by shape variation of a discharge tube as in a quartz discharge tube, achieves highly efficient and stable lifetime characteristics independent of the presence or absence and the composition of a gas in an outer tube, suppresses leaks during a lamp operation and characteristic changes caused by a reaction between a sealing material and an enclosed material, has stable lamp starting characteristics, and allows a free design of the discharge tube.

A high-pressure metal vapor discharge lamp of the present invention includes an outer tube sealed air-tight by a stem, and a discharge tube of transparent ceramic in which mercury, a rare gas and a discharge metal are sealed, the discharge tube being inside the outer tube. The discharge tube includes a main tube, a pair of slender tubes disposed at both ends of the main tube, at least a pair of main electrodes located in the main tube and at least an auxiliary electrode located in the main tube. The pair of main electrodes are connected to electrode lead-in members that are sealed in the slender tubes with a sealing material, the auxiliary electrode is connected to an auxiliary electrode lead-in member, and the auxiliary electrode lead-in member connected to the auxiliary electrode is isolated electrically from the electrode lead-in member connected to the main electrode and sealed in the slender tube with a sealing material.

Unlike a conventional high-pressure metal vapor discharge lamp using the quartz discharge tube, this structure can eliminate the shape variation of the discharge tube, which has been inevitable conventionally. Thus, it is possible to reduce the variations in lamp characteristics caused by this shape variation. Also, the reaction between the enclosed metals and the discharge tube can be suppressed, thus reducing variation in optical characteristics of the lamp, making it possible to reduce the characteristic change during its lifetime.

Also, it becomes possible to lower the temperature of the sealing material during the operation, thus preventing corrosion of the sealing material by a reaction between the enclosed metals and the sealing material easily. Accordingly, reliability can be improved compared with the conventional structure of the sealing portions.

Furthermore, since the auxiliary electrode lead-in member to which the auxiliary electrode is connected and the electrode lead-in member to which the main electrode is connected are sealed in the same slender tube, it becomes possible to reduce the distance between the auxiliary electrode and the main electrode next to it, thus lowering a starting voltage. Moreover, since it is sufficient that one slender tube each is disposed at both ends of the discharge tube, the discharge tube can be designed in a relatively free manner.

In addition, an alternative main electrode can be used instead of the auxiliary electrode (or in addition to the auxiliary electrode) in the above-described structure of the present invention. This achieves the structure in which a switching element selects the main electrode or the alternative main electrode to light the lamp.

Such structure reduces the frequency at which the main electrode or the alternative main electrode is exposed to sputter caused by a high voltage at lamp start-up or to high temperature during the lamp operation, thereby suppressing the consumption of each electrode.

BEST MODE FOR CARRYING OUT THE INVENTION

The following is a description of embodiments of the present invention.

(First Embodiment)

Figure 1:
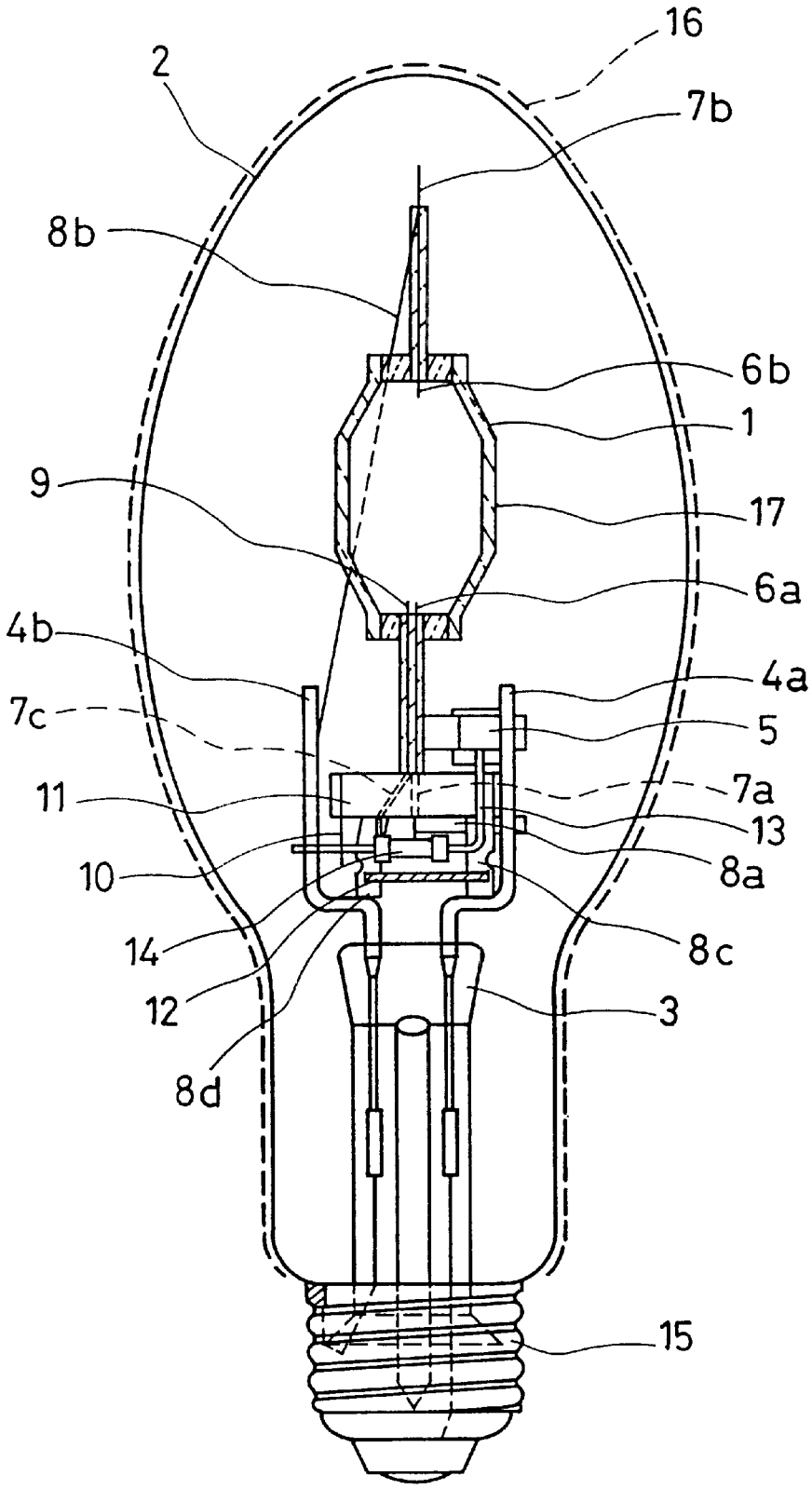
FIG. 1 is a front elevation of a high-pressure metal vapor discharge lamp in accordance with a first embodiment of the present invention.

A high-pressure metal vapor discharge lamp with a rated lamp power of 100 W shown in FIG. 1, which is a first embodiment of the present invention, includes a discharge tube 1 made of transparent ceramics inside an outer tube 2. One end of the outer tube 2 is provided with a stem 3, which seals the outer tube 2 air-tight. The stem 3 is provided with lead-in support wires 4*a* and 4*b* next to each other, and the discharge tube 1 is supported by a discharge tube support plate 5 that is provided on this lead-in support wire 4*a*.

The two ends of the discharge tube 1 are provided with a first main electrode 6*a* and a second main electrode 6*b* so as to be located in a main tube 17 serving as a discharge space. On the side of the main electrode 6*a,* an auxiliary electrode 9 also is provided so as to be located in the main tube 17 serving as the discharge space and be spaced away suitably from the main electrode 6*a*.

One end of an external lead-in wire 7*a* for supplying an electric current to the main electrode 6*a* that is opposite to the main electrode 6*a* is connected to a connecting wire 8*a* that is connected to the lead-in support wire 4*a*. The main electrode 6*a* is supplied with a current via the lead-in support wire 4*a,* the connecting wire 8*a* and the external lead-in wire 7*a*.

On the other hand, the main electrode 6*b* is supplied with a current via a lead-in support wire 4*b,* a connecting wire 8*b* and an external lead-in wire 7*b*.

The other end of an external lead-in wire 7*c* for supplying a current to the auxiliary electrode 9 is connected to one end of a connecting wire 8*d,* the other end of the connecting wire 8*d* is connected to one end of a current limiting resistor 12, and the other end of the current limiting resistor 12 is connected to a bimetal 11 serving as a thermally-activated element having a bimetal pin 10 at its front end via a connecting wire 8*c*. This bimetal 11 is connected to a bimetal support wire 13. The bimetal support wire 13 has an insulator 14 in the middle and both ends that are insulated electrically. One end of the bimetal support wire 13 is connected to the bimetal 11 via the connecting wire 8*c* that is connected to the current limiting resistor 12, and also is fastened by the discharge tube support plate 5 that is insulated electrically. The other end of the bimetal support wire 13 is connected to the lead-in support wire 4*b*. The bimetal pin 10 is placed so as to make and break contact with the bimetal support wire 13 on the side of the lead-in support wire 4*b*. Operation of this bimetal pin 10 connects and disconnects the lead-in support wire 4*b* and the bimetal 11 electrically.

In this manner, the auxiliary electrode 9 is supplied with a current via the lead-in support wire 4*b*, the bimetal support wire 13, the bimetal pin 10, the bimetal 11, the connecting wire 8*c*, the current limiting resistor 12, the connecting wire 8*d* and the external lead-in wire 7*c*. After a transition to a main discharge, the operation of the bimetal 11 spaces the bimetal pin 10 and the bimetal support wire 13 that is connected to the lead-in support wire 4*b* away from each other, thus terminating the current supply to the auxiliary electrode 9.

A lamp base 15 is provided at one end of the outer tube 2 and supplies an electric current from a lighting circuit etc. outside (not shown in the drawing) to the lead-in support wires 4*a* and 4*b*. Also, a fluororesin film 16 is applied to and formed on the surface of the outer tube 2 for a protection against an outer tube breakage.

Figure 2:
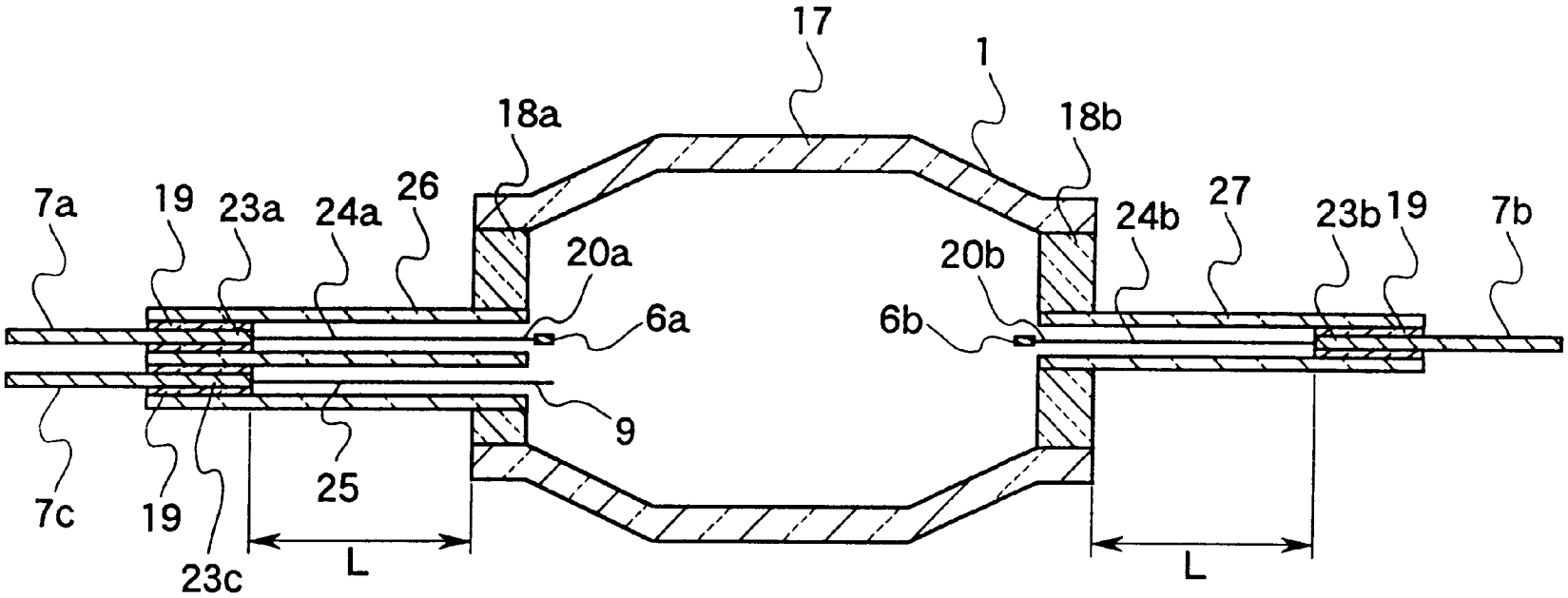
FIG. 2 is a sectional view of a discharge tube used in the lamp shown in FIG. 1.

The discharge tube 1 in the present embodiment shown in FIG. 2 is constituted by forming a first disk 18*a* and a second disk 18*b* that are made of transparent ceramics having alumina as a main component into one piece with the main tube 17 made of transparent ceramics having alumina as a main component at openings at both ends by shrink fitting so as to form an air-tight seal. The first disk 18*a* and the second disk 18*b* also are formed into one piece with one end of a two-hole slender tube 26 and one end of a slender tube 27 respectively by shrink fitting.

Figure 3:
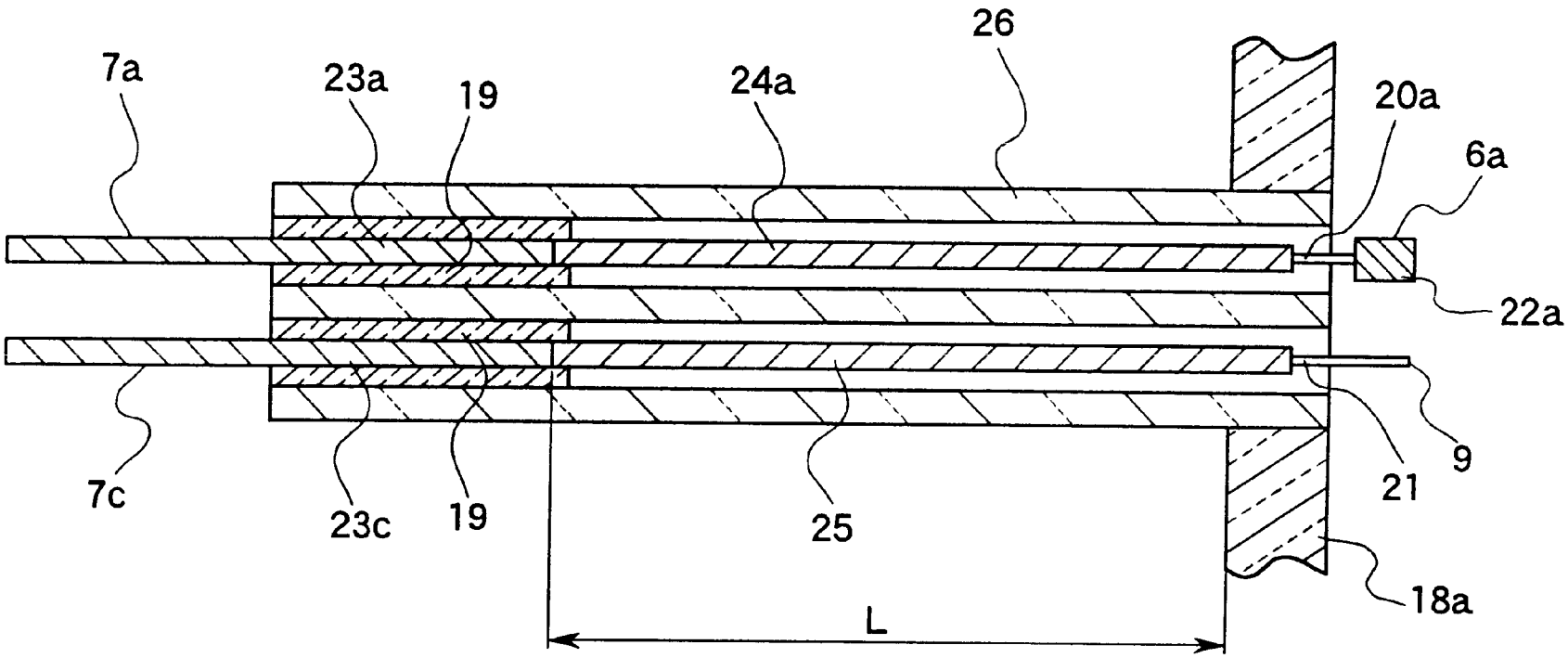
FIG. 3 is a sectional view of a two-hole slender tube used in the lamp shown in FIG. 1.

The two-hole slender tube 26 has two through holes that are substantially parallel to its longitudinal direction. As shown in FIG. 3, a columnar sealed member 23*a* that is made of niobium and also serves as the external lead-in wire 7*a*, a first main electrode lead-in wire 24*a* made of molybdenum as the electrode lead-in member and a first main electrode axis 20*a* made of tungsten are formed into one piece so as to be inserted into one of the through holes in the two-hole slender tube 26. On the other hand, a sealed member 23*c* that is made of niobium and also serves as the external lead-in wire 7*c*, an auxiliary electrode lead-in wire 25 made of molybdenum as the auxiliary electrode lead-in member and an auxiliary electrode axis 21 that has the auxiliary electrode 9 at its tip and is made of tungsten are formed into one piece so as to be inserted into the other through hole in the two-hole slender tube 26. The sealed members 23*a* and 23*c* both are sealed in the two-hole slender tube 26 with a glassy sealing material 19 having alumina and silica as main components. An electrode coil 22*a* made of tungsten is attached to the tip of the first main electrode axis 20*a* so as to constitute the first main electrode 6*a*, and the electrode coil 22*a*, i.e., the first main electrode 6*a* is arranged so as to be located in the main tube 17.

As shown in FIG. 2, a columnar sealed member 23*b* that is made of niobium and also serves as the external lead-in wire 7*b*, a second main electrode lead-in wire 24*b* made of molybdenum as the electrode lead-in member and a second main electrode axis 20*b* made of tungsten are formed into one piece so as to be inserted into the through hole in the slender tube 27. The slender tube 27 and the sealed member 23*b* are sealed air-tight with the glassy sealing material 19 having alumina and silica as main components.

Next, the discharge tube 1 was produced so that the distance L from the outer end face of the main tube 17 as the discharge space to the end face of the sealed members 23*a*, 23*b* and 23*c* on the discharge space side was 4 mm, as shown in FIGS. 2 and 3. This discharge tube 1 was mounted on the high-pressure metal vapor discharge lamp shown in FIG. 1, and the presence or absence of leaks in the discharge tube was examined during 3000 hours use in cycles (each cycle includes 5.5 hours of lighting and 0.5 hours of non-lighting) for comparison with a comparative product. When the leaks occur in the discharge tube, colored enclosed materials jet from a leak position of the discharge tube and adhere to an inner surface of the outer tube, so the occurrence of the leaks can be confirmed easily by visual observation. Table 1 shows the results of these measurements.

Figure 10:
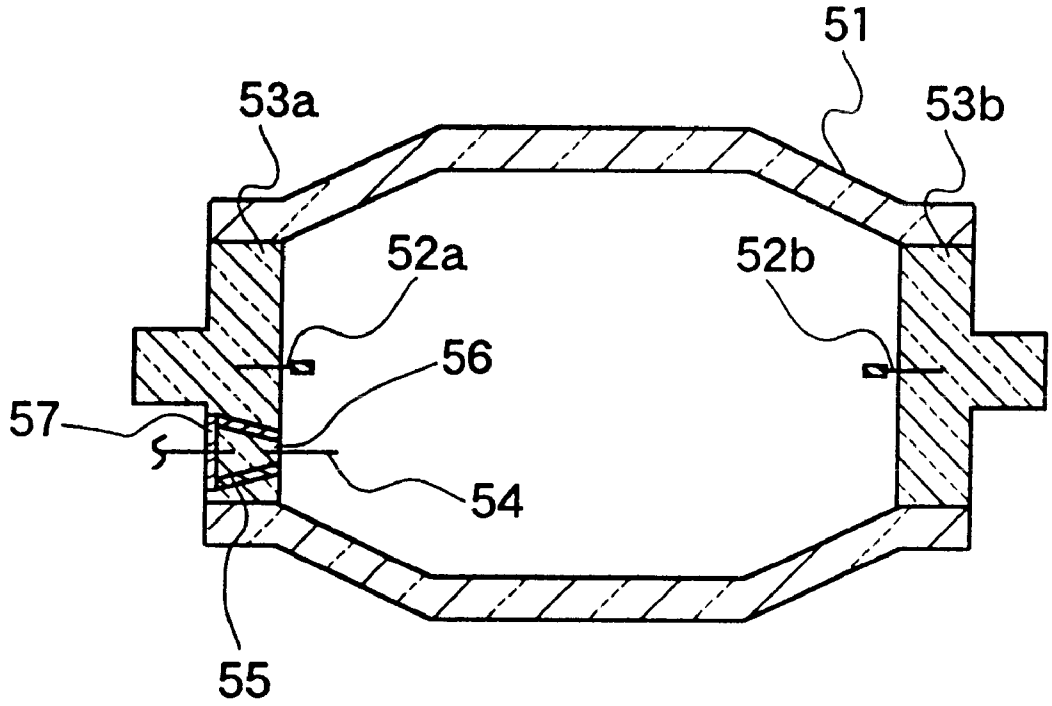
FIG. 10 (PRIOR ART)
FIG. 10 is a sectional view of a discharge tube of another conventional high-pressure metal vapor discharge lamp (a comparative product for leaks).

As the comparative product, a high-pressure metal vapor discharge lamp having a ceramic discharge tube with a structure described in JP 62-150646 A shown in FIG. 10 (referred to as a comparative product for leaks in the following) was used. That is, electrically conductive cermet disks 53*a* and 53*b* supporting main electrode rods 52*a* and 52*b* were sealed air-tight at both ends of a discharge tube 51, and the disk 53*a* supported an auxiliary electrode 54 with being insulated from the main electrode rod 52*a*. The other structure was the same as that of the high-pressure metal vapor discharge lamp of the present embodiment.

For both discharge lamps, a predetermined amount of mercury, Ne—Ar mixed gas for a starting gas and iodides of sodium, thallium, indium and lithium as metal halides were sealed in the discharge tube. Ne—$N_2$ mixed gas was sealed in the outer tube 2, and the state after operation at 100 W was examined. In the discharge tube 1 of the discharge lamp of the present invention, the main tube 17 had a maximum outer diameter of 11 mm, the two-hole slender tube 26 had an outer diameter of 4.0 mm, the slender tube 27 had an outer diameter of 2.1 mm, and the sealed members 23*a*, 23*b* and 23*c* made of niobium had an outer diameter of 0.9 mm.

TABLE 1

| | Occurrence of leaks |
|---|---|
| Product of the present invention | 0% |
| Comparative product for leaks | 42% |

As is clear from Table 1, it is confirmed that the product of the present invention achieved a seal structure without leaks. This is because the sealed members 23*a*, 23*b* and 23*c* maintain a certain distance from the main tube 17 that reaches a high temperature during the lamp operation, thereby lowering the temperature to a degree not causing a breakage of the sealed members and the slender tube even when subjected to a thermal shock due to repeated lighting and extinguishing. In the present embodiment, niobium was used as the sealed members 23*a*, 23*b* and 23*c*, but one of tantalum, platinum, rhenium and electrically conductive cermet may be used instead to achieve a similar effect.

Furthermore, after being operated for 1 hour with its lamp base 15 facing upward, the product of the present invention was kept in a cold and dark place for 12 hours maintaining its orientation the same as that during the operation, then a starting voltage of the lamp was examined. Voltage from 120

V to rated 200 V was applied to the lighting circuit of the lamp at increases of 5 V for 10 seconds each, and the voltage when the lamp was lit was determined to be the starting voltage of the lamp.

In addition, as a lifetime test, a luminous flux maintenance factor and a color temperature change were examined after 3000 hours use in cycles (each cycle includes 5.5 hours of lighting and 30 minutes of non-lighting) for comparison with a comparative product. Both the luminous flux and the color temperature were measured with a spherical photometer, and the luminous flux maintenance factor and the color temperature change were determined in comparison with the measured values prior to the lifetime test.

In the product of the present invention, the experiment was conducted by changing a filling pressure of the starting gas (Ne—Ar mixed gas) in the discharge tube into two conditions. The results of the measurements are shown in FIG. 2.

Figure 11:
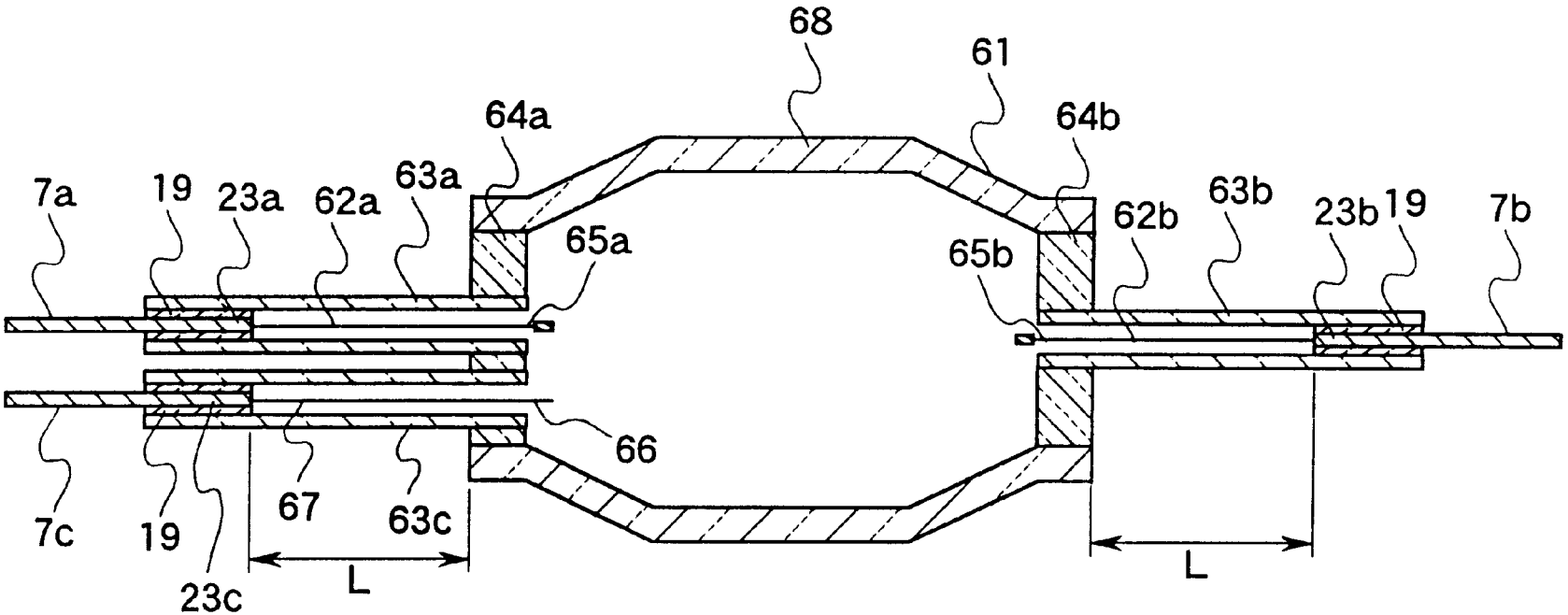
FIG. 11 (PRIOR ART)
FIG. 11 is a sectional view of a discharge tube of still another conventional high-pressure metal vapor discharge lamp (a comparative product for lamp start-up).

As the comparative product, a high-pressure metal vapor discharge lamp having a ceramic discharge tube with a structure described in JP 10-106491 A shown in FIG. 11 (referred to as a comparative product for lamp start-up in the following) was used. That is, one end of a transparent ceramic discharge tube 61 was provided with two slender tubes, which are a slender tube 63*a* through which a main electrode axis 62*a* formed into one piece with a main electrode 65*a* passed and a slender tube 63*c* through which an auxiliary electrode axis 67 formed into one piece with an auxiliary electrode 66 passed. The other end was provided with a slender tube 63*b* through which a main electrode axis 62*b* formed into one piece with a main electrode 65*b* passed. The first main electrode 65*a* and the second main electrode 65*b* were provided so as to be located in an main tube 68 as a discharge space, and on the side of the main electrode 65*a*, the auxiliary electrode 66 also was provided so as to be located in the main tube 68 as the discharge space and be spaced away suitably from the main electrode 65*a*. The other structure was the same as that of the high-pressure metal vapor discharge lamp of the present embodiment.

TABLE 2

| | Filling gas pressure | Starting voltage | Luminous flux maintenance factor | Color temperature change |
|---|---|---|---|---|
| Product of the present invention | 10 KPa | 150 V | 72% | −725 K. |
| Product of the present invention | 15 KPa | 170 V | 85% | −211 K. |
| Comparative product for start-up | 10 KPa | 190 V | 74% | −758 K. |

As becomes clear from Table 2, it could be confirmed that the product of the present invention achieved a lower starting voltage of the lamp compared with the comparative product for lamp start-up, suppressed an occurrence of poor start-ups and obtained stable characteristics in the lifetime test as well. Such low starting voltage was achieved because the distance between the main electrode and the auxiliary electrode next to each other in the product of the present invention, which was 1 mm, was smaller than that in the comparative product for start-up, which was 3 mm, thus lowering a discharge starting voltage. Also, when the filling gas pressure is raised, the discharge starting voltage increases, while a glow-to-arc time at lamp start-up decreases so as to suppress the electrode consumption, thus improving the luminous flux maintenance factor. In other words, by setting the filling gas pressure suitably, it becomes possible to achieve low lamp starting voltage and stable characteristics in the lifetime test.

In addition, in the discharge tube 1 of the present embodiment, the first disk 18*a* and the second disk 18*b* were fit into the main tube 17 by shrink fitting, and one end of the two-hole slender tube 26 and one end of the slender tube 27 were fit into the first disk 18*a* and the second disk 18*b* respectively also by shrink fitting. However, at least two components, for example, the first disk 18*a* and the two-hole slender tube 26 can be formed into one piece in advance, thereby further improving the reliability of air-tight sealing of the discharge tube. It is needless to say that the main tube, the disks, the two-hole slender tube and the slender tube all may be formed into one piece in advance.

Although the 100 W lamp was discussed in the above description, similar effects were confirmed when using 250 W lamp and 400 W lamp.

As described above, the high-pressure metal vapor discharge lamp of the present embodiment according to the present invention can achieve the sealing structure without leaks in the discharge tube. In addition, since the distance between the main electrode and the auxiliary electrode can be reduced, it is possible to lower the starting voltage of the lamp so as to achieve stable starting characteristics. It also is possible to improve lifetime characteristics.

(Second Embodiment)

Next, the following is a description of a second embodiment of the present invention.

Figure 4:
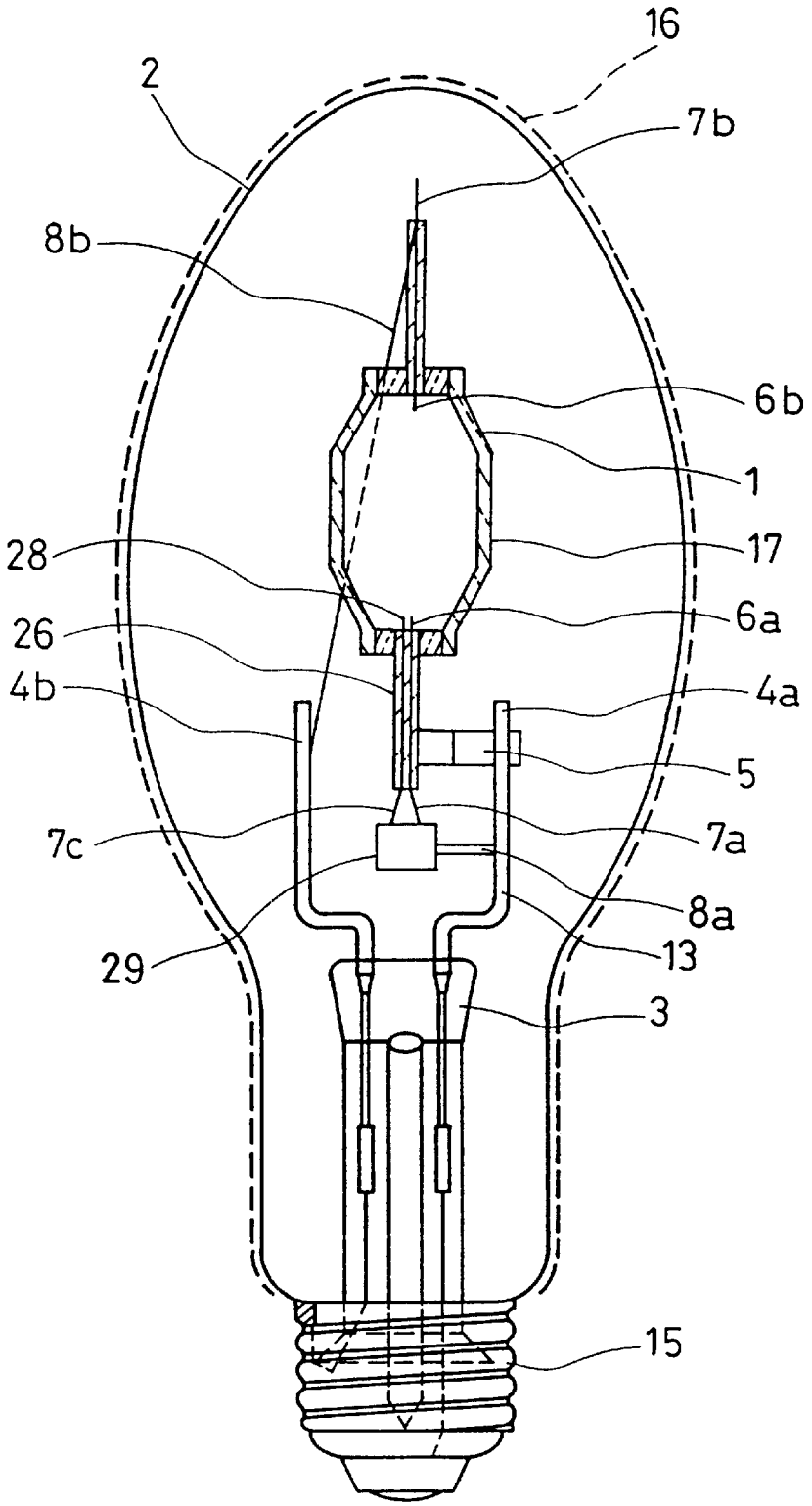
FIG. 4 is a front elevation of a high-pressure metal vapor discharge lamp in accordance with a second embodiment of the present invention.

The present embodiment has a structure that, in the high-pressure metal vapor discharge lamp of the first embodiment, an alternative main electrode 28 is inserted instead of the auxiliary electrode so as to provide two main electrodes in the two-hole slender tube 26 as shown in FIG. 4, and a switching element 29 selects either the first main electrode 6*a* or the alternative main electrode 28 when starting the lamp operation.

Such a structure can reduce the frequency of using each main electrode. Thus, it is possible to suppress lamp voltage change during lifetime, which is due to discharge length change caused by consumption of the main electrode, thereby achieving stable characteristics.

In addition, it may be possible to adopt the structure that at least three through holes are provided in the slender tube so as to use more main electrodes, or that the auxiliary electrode is inserted into one or more through holes so as to lower the starting voltage.

(Third Embodiment)

Next, the following is a description of a third embodiment of the present invention.

Figure 5:
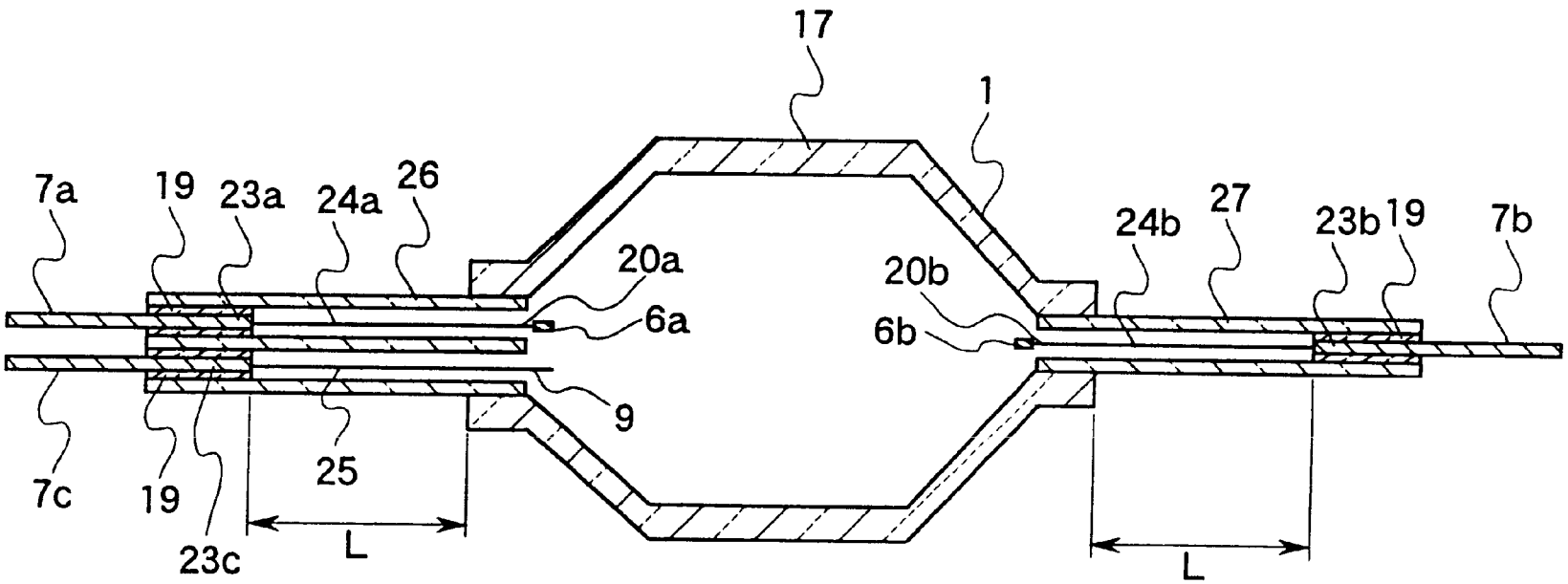
FIG. 5 is a sectional view of a discharge tube of a high-pressure metal vapor discharge lamp in accordance with a third embodiment of the present invention.

The present embodiment has a structure that, in the high-pressure metal vapor discharge lamp of the first embodiment, the disks are omitted from the discharge tube 1 so as to seal the main tube 17 and respective ends of the two-hole slender tube 26 and the slender tube 27 air-tight by shrink fitting as shown in FIG. 5.

With such a structure, it becomes possible to reduce the heat capacity in the end shape of the main tube 17, thus suppressing thermal loss, and to design the end shape freely, thus controlling a coldest-spot temperature, which determines a vapor pressure of enclosed metals. Accordingly, a desired discharge can be obtained, thereby improving the lamp efficiency.

In addition, at least two components, for example, the main tube 17 and the two-hole slender tube 26 can be formed into one piece in advance, thereby further improving reliability of air-tight sealing of the discharge tube. It is needless to say that the main tube, the two-hole slender tube and the slender tube all may be formed into one piece in advance.

(Fourth Embodiment)

Next, the following is a description of a fourth embodiment of the present invention.

Figure 6:
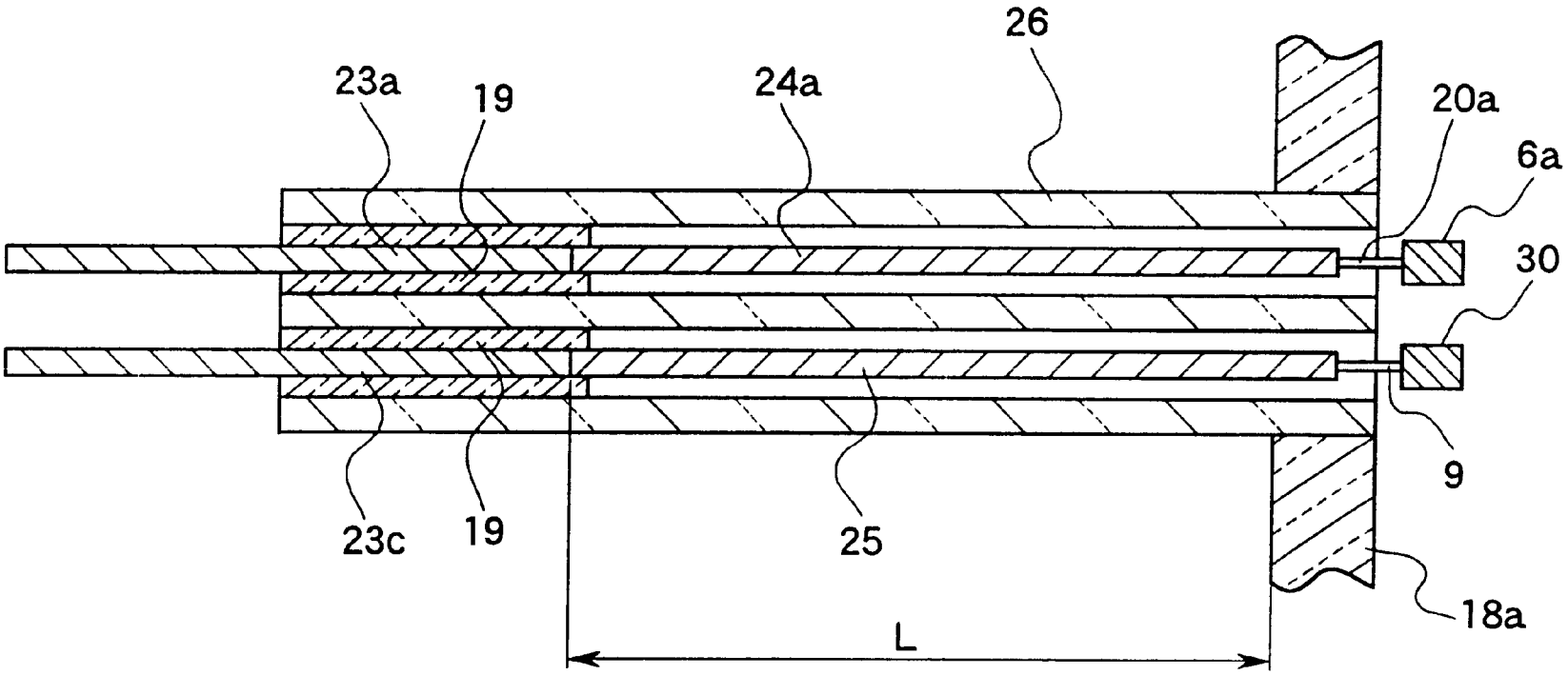
FIG. 6 is a sectional view of a two-hole slender tube of a discharge tube of a high-pressure metal vapor discharge lamp in accordance with a fourth embodiment of the present invention.

The present embodiment has a structure that, in the high-pressure metal vapor discharge lamp of the first embodiment, an auxiliary electrode coil 30 is provided at the tip of the auxiliary electrode 9 as shown in FIG. 6.

With such a structure, the distance between the first main electrode 6*a* and the auxiliary electrode 9 further is reduced, so that not only an electric field strength increases, but also the electric field is applied to the coil portion with an incident angle, making it easier to emit electrons.

Also, this structure makes it possible to apply an emissive material to the auxiliary electrode coil or impregnate the auxiliary electrode coil with the emissive material. By applying the emissive material only to the auxiliary electrode or impregnating only the auxiliary electrode with the emissive material, the following effects can be obtained. That is, during a stable lamp operation, the auxiliary electrode that is insulated electrically by the bimetal is not exposed directly to a high temperature caused by the discharge, thereby preventing the emissive material from being scattered. As a result, it becomes possible to prevent leaks by suppressing the reaction of the emissive material with the enclosed material and the discharge tube material and by suppressing the reaction of the emissive material with the sealing material, while maintaining stable starting characteristics during lifetime.

(Fifth Embodiment)

Next, the following is a description of a fifth embodiment of the present invention.

Figure 7:
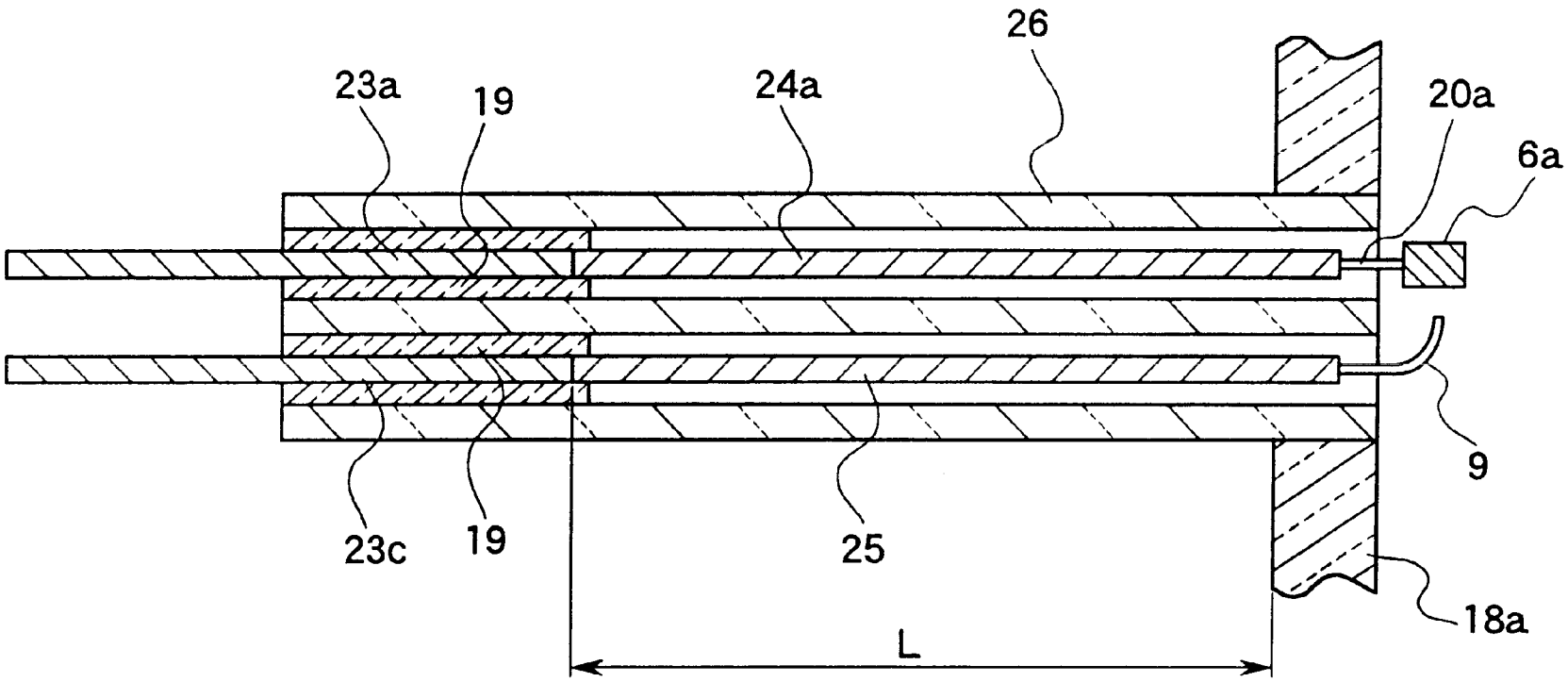
FIG. 7 is a sectional view of a two-hole slender tube of a discharge tube of a high-pressure metal vapor discharge lamp in accordance with a fifth embodiment of the present invention.

The present embodiment has a structure in which, in the high-pressure metal vapor discharge lamp of the first embodiment, a part of the auxiliary electrode 9 is located closer to the side of the first main electrode 6*a* beyond an inner wall surface of the through hole of the two-hole slender tube 26 in which the auxiliary electrode 9 is inserted as shown in FIG. 7.

The tip of the auxiliary electrode 9 is formed with a heat resistant and halide resistant material such as tungsten or molybdenum, and has a wire diameter of about 0.3 mm or smaller and sufficient elasticity. After being deformed into a predetermined shape in advance, the tip of the auxiliary electrode 9 is inserted through the through hole, so as to restore its initial shape inside the discharge tube.

With such a structure, the distance between the first main electrode 6*a* and the auxiliary electrode 9 further is reduced, thereby lowering a starting voltage.

The shape of the tip of the auxiliary electrode 9 is not limited to that bent toward the side of the main electrode 6*a* as shown in FIG. 7. For example, a portion that is a little closer to the auxiliary electrode lead-in wire 25 from the tip may be bent into a "U"-shape ("Ω"-shape) so that its convex portion faces toward the main electrode 6*a*. Also, the auxiliary electrode 9 itself may not only be transformed as in the present embodiment, but also be provided with the coil described in the fourth embodiment and then located closer to the side of the main electrode 6*a*.

(Sixth Embodiment)

Next, the following is a description of a sixth embodiment of the present invention.

Figure 8:
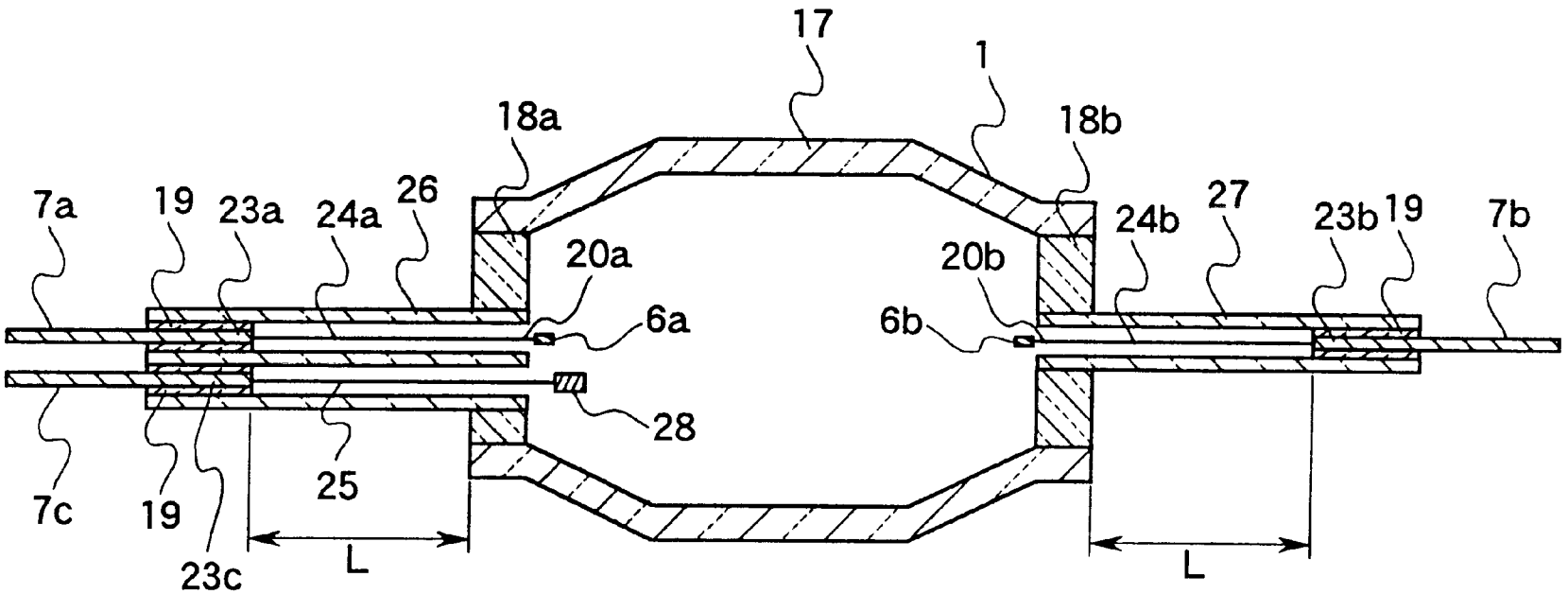
FIG. 8 is a sectional view of a discharge tube of a high-pressure metal vapor discharge lamp in accordance with a sixth embodiment of the present invention.
Figure 9:
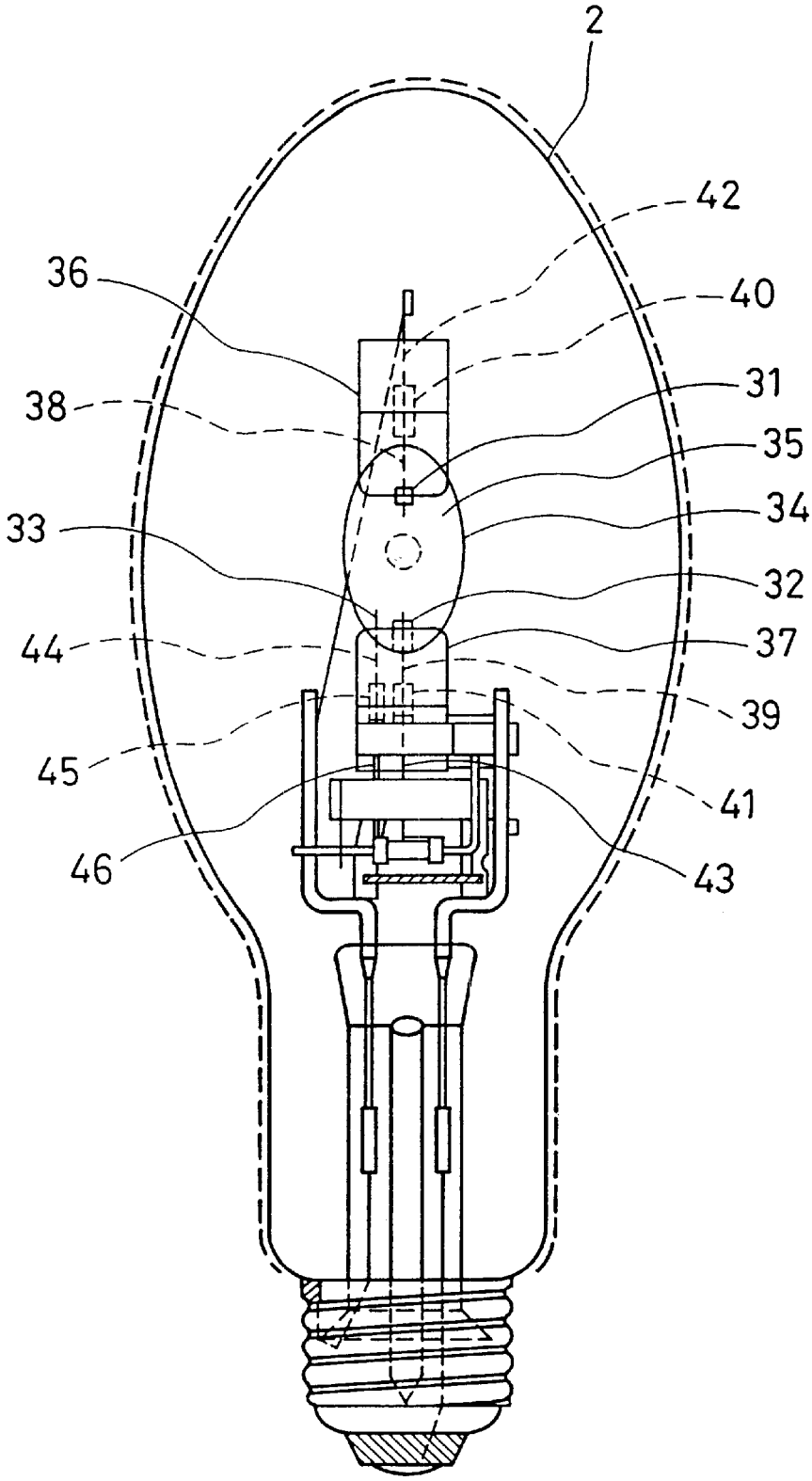
FIG. 9 (PRIOR ART)
FIG. 9 is a front elevation of a conventional high-pressure metal vapor discharge lamp.

The present embodiment has a structure that, in the high-pressure metal vapor discharge lamp of the second embodiment, the distance from the alternative main electrode 28 to the facing main electrode 6*b* is smaller than that from the main electrode 6*a* next to the alternative main electrode 28 to the main electrode 6*b* as shown in FIG. 8.

In an initial period of the lamp lifetime, the switching element 29 set the discharge to occur between the main electrodes. In a later period of the lamp lifetime, where blackening of the discharge tube etc. raise the lamp voltage so that the lamp might die out during its lifetime, the switching element 29 selects the alternative main electrode 28. Such a structure reduces an arc length in the later period of the lifetime so as to lower the lamp voltage and prevent the lamp from dying out, thereby extending the lamp lifetime.

As described above, with the high-pressure metal vapor discharge lamp of the above embodiments in accordance with the present invention, after turning on a power source, the auxiliary discharge begins between the main electrode and the auxiliary electrode, followed by a prompt transition to the main discharge between the main electrodes, then a stable discharge condition is maintained. Also, unlike the quartz discharge tube, the shape variation depending on the forming of ceramic materials and the variations in lamp in characteristics caused by this shape variation can be reduced. At the same time, since ceramics that have a small reactivity with the enclosed iodides are used, it is possible to obtain the high-pressure metal vapor discharge lamp having a high efficiency independent of the presence or absence and composition of the gas in the outer tube and stable lifetime characteristics with less change in the luminous flux maintenance factor and the color temperature during its lifetime. Also, the use of the alternative main electrode makes it possible to achieve stable lifetime characteristics and a longer lifetime of the lamp.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A high-pressure metal vapor discharge lamp comprising:

an outer tube sealed air-tight by a stem; and a discharge tube of transparent ceramic in which mercury, a rare gas and a discharge metal are sealed, the discharge tube being inside the outer tube;

wherein the discharge tube comprises a main tube, a pair of slender tubes disposed at both ends of the main tube, at least a pair of main electrodes located in the main tube and at least an auxiliary electrode located in the main tube, the pair of main electrodes are connected to electrode lead-in members that are sealed in the slender tubes with a sealing material, and the auxiliary electrode is connected to an auxiliary electrode lead-in member, and the auxiliary electrode lead-in member connected to the auxiliary electrode is isolated electrically from the electrode lead-in member connected to the main electrode and sealed in the slender tube with a sealing material.

2. The high-pressure metal vapor discharge lamp according to claim 1, wherein the pair of slender tubes are connected directly to both ends of the main tube.

3. The high-pressure metal vapor discharge lamp according to claim 1, wherein the auxiliary electrode has a coil.

4. The high-pressure metal vapor discharge lamp according to claim 3, wherein an electron emissive material is applied to the coil of the auxiliary electrode or the coil of the auxiliary electrode is impregnated with an electron emissive material.

5. The high-pressure metal vapor discharge lamp according to claim 1, wherein at least a part of the auxiliary electrode located in the main tube is closer to a side of the main electrode next to the auxiliary electrode beyond an inner wall surface of the slender tube in which the auxiliary electrode lead-in member to which the auxiliary electrode is connected is inserted.

6. A high-pressure metal vapor discharge lamp comprising:

an outer tube sealed air-tight by a stem; and a discharge tube of transparent ceramic in which mercury, a rare gas and a discharge metal are sealed, the discharge tube being inside the outer tube;

wherein the discharge tube comprises a main tube, a pair of slender tubes disposed at both ends of the main tube, at least a pair of main electrodes located in the main tube and at least an alternative main electrode located in the main tube;

the pair of main electrodes are connected to electrode lead-in members that are sealed in the slender tubes with a sealing material, and the alternative main electrode is connected to an alternative electrode lead-in member, and the alternative electrode lead-in member connected to the alternative main electrode is isolated electrically from the electrode lead-in member connected to the main electrode and sealed in the slender tube with a sealing material.

7. The high-pressure metal vapor discharge lamp according to claim 6, wherein the main tube further comprises an auxiliary electrode, the auxiliary electrode being connected to an auxiliary electrode lead-in member, and the auxiliary electrode lead-in member connected to the auxiliary electrode is isolated electrically from the electrode lead-in member connected to the main electrode and the alternative electrode lead-in member connected to the alternative main electrode and sealed in the slender tube with a sealing material.

8. The high-pressure metal vapor discharge lamp according to claim 7, wherein the auxiliary electrode has a coil.

9. The high-pressure metal vapor discharge lamp according to claim 7, wherein at least a part of the auxiliary electrode located in the main tube is closer to a side of the main electrode next to the auxiliary electrode beyond an inner wall surface of the slender tube in which the auxiliary electrode lead-in member to which the auxiliary electrode is connected is inserted.

10. The high-pressure metal vapor discharge lamp according to claim 6, wherein a distance from a tip of the alternative main electrode to the facing main electrode is smaller than that from a tip of the main electrode next to the alternative main electrode to the facing main electrode.

11. The high-pressure metal vapor discharge lamp according to claim 6, wherein the pair of slender tubes are connected directly to both ends of the main tube.

* * * * *

UNITED STATES PATENT AND TRADEMARK OFFICE

CERTIFICATE OF CORRECTION

PATENT NO. : 6,483,230 B1
DATED : November 19, 2002
INVENTOR(S) : Oda et al.

It is certified that error appears in the above-identified patent and that said Letters Patent is hereby corrected as shown below:

Title page,
Item [54], Title, "HIGH PRESSURE METALLIC" should read
-- HIGH-PRESSURE METAL --

Signed and Sealed this

Tenth Day of February, 2004

JON W. DUDAS
*Acting Director of the United States Patent and Trademark Office*